United States Patent [19]

Fishter et al.

[11] 4,425,185

[45] Jan. 10, 1984

[54] METHOD AND COMPOSITION FOR REMOVING NICKEL ALUMINIDE COATINGS FROM NICKEL SUPERALLOYS

[75] Inventors: Robert E. Fishter, Boca Raton; Henry Lada, Lake Park; Victoria M. Putnam, Jupiter, all of Fla.

[73] Assignee: United Technologies Corporation, Hartford, Conn.

[21] Appl. No.: 359,547

[22] Filed: Mar. 18, 1982

[51] Int. Cl.[3] ..... C23F 1/02; B44C 1/22

[52] U.S. Cl. ..... 156/656; 134/3; 156/664; 156/665; 252/79.2

[58] Field of Search ..... 134/3, 28, 41; 156/664, 156/665, 656, 667; 252/79.2, 147

[56] References Cited

U.S. PATENT DOCUMENTS

| | | | |
|---|---|---|---|
| 4,032,359 | 6/1977 | Fisher et al. | 134/3 |
| 4,274,908 | 6/1981 | Fishter et al. | 156/637 |
| 4,302,246 | 11/1981 | Brindisi, Jr. et al. | 75/101 |
| 4,325,756 | 4/1982 | Brown et al. | 148/32.5 |
| 4,339,282 | 7/1982 | Lada et al. | 134/3 |
| 4,353,780 | 10/1982 | Fishter et al. | 156/664 |

*Primary Examiner*—William A. Powell

*Attorney, Agent, or Firm*—C. G. Nessler

[57] ABSTRACT

Disclosed is a method for stripping nickel aluminide coatings of up 10 weight percent aluminum from nickel base alloy substrates at room temperature. The preferred solution contains by volume percent 43–45 nitric acid, 7–12 hydrochloric acid, 0.1–1.5 sulfuric acid, balance water; it also contains 0.008–0.025 moles per liter of ferric chloride, at least 0.016 moles per liter copper sulfate. The ratio between the sulfate and chloride is 2:1 or greater.

4 Claims, No Drawings

METHOD AND COMPOSITION FOR REMOVING NICKEL ALUMINIDE COATINGS FROM NICKEL SUPERALLOYS

The Government has rights in this invention pursuant to Contract N00019-79-C-0013 awarded by the Department of the Navy.

TECHNICAL FIELD

The present invention relates to the chemical stripping of certain nickel aluminum alloy coatings from certain nickel alloy base metals.

BACKGROUND

Components used in gas turbine engines are commonly made of high temperature oxidation and corrosion resistant superalloys. Nonetheless, coatings are often applied to the surface of such alloys, to protect them from environments beyond their inherent capability, or to impart specialized surface properties.

Nickel aluminide coatings are used for such purposes. They are predominantly nickel, with small quantities (~5%) of aluminum. When applied as plasma sprayed coatings, the nickel aluminide materials can provide a surface which is oxidation and corrosion resistant, but which has more abradability than is obtainable in a conventional cast or forged superalloy. Thus, these types of coatings are utilized where there is a need for tight clearance, but the possibility of metal to metal contact exists. As a particular example, nickel aluminide coatings are used on the outer airseals in low pressure turbine parts of a gas turbine engine. The outer airseal pieces are made typically of a nickel superalloy, and form a circumferential ring which encircles turbine blades mounted in a spinning disc.

With use of a gas turbine engine, there is degradation of the nickel aluminide coatings, as occurs ordinarily with use of various components. Periodically, a gas turbine engine will be overhauled, and at this time it is desirable to refurbish the outer airseals. Because of the corrosion and oxidation products which form on the outer airseal surfaces, and to provide a good bond for new coating material, it is necessary to entirely remove the old coating. Using mechanical means, such as severe abrasive blasting or machining, risks removing parts of the base metal airseal and can be too costly.

Chemical removal of coatings using stripping solutions is an obvious choice. However, difficulty arises when there is a similarity in composition between the coating and the substrate base metal, as there is for nickel aluminide coated airseals. A chemical solution which attacks the coating may also attack the base metal of the component, producing either gross removal of substrate material (which is undesirable in the same sense as mis-machining is) or preferential corrosion attack and weakening of the substrate. Solutions which are weak, so that they do not attack the base metal, will be ineffective in removing the coatings within a commercially feasible time. Among the commercial stripping materials which have been found to be not satisfactory are conventional sodium cyanide aqueous solutions and proprietary alkaline non-cyanide salt solutions, such as Metex Strip Aid Salts (McDermid Corp., Waterbury, CT) and Enstrip-S (Enthone Corp., New Haven, CT), solutions which are well known in the prior art to be generally useful for stripping. The attack on nickel aluminide is unduly slow or non-existent, and removal is not possible even after hundreds of hours of immersion at room temperature.

There are some co-pending U.S. patent applications which have the applicants Fishter and Lada as common inventors, and which relate to chemical milling: Application Ser. No. 338,739, Selective Chemical Milling of Recast Surfaces, filed Jan. 11, 1982, relates to the removal of the recast layer resulting from electric discharge machining, as opposed to the removal of the base metal. Application Ser. No. 192,667, filed Oct. 1, 1980 now U.S. Pat. No. 4,353,780, Chemical Milling of High Tungsten Content Superalloys, relates to solutions which are suitable for chemical milling alloys which have relatively high tungsten content, compared to superalloys in general. U.S. Pat. No. 4,339,282 Method and Composition for Removing Aluminide Coatings from Nickel Superalloys, discloses a solution having nitric and hydrochloric acids, suitable for removing pack cementation (diffusion type) aluminide coatings from cast superalloys. Such coatings usually have 20–30 weight percent aluminum, plus silicon, in addition to the other elements which comprise the substrate, and are distinguishable from the low aluminum coatings to which the present invention is pertinent. Sizer et al. in Australian Patent AU-B 10761/76 discloses another method for removing diffused aluminum coatings from high Cr content superalloys by immersion in an aqueous bath of 5–40 volume percent nitric acid. Vigorous agitation is needed to prevent localized pitting of the substrate.

In U.S. Pat. No. 4,274,908 to Fishter et al., a chemical milling solution usable for removing gold-nickel type brazed material from superalloy articles is disclosed; the solution contains nitric acid, sulfate ions, chloride ions, and metal ions.

The foregoing applications and patents indicate that for each situation there appears to be a critical combination of chemicals which obtains the desired expeditious removal of unwanted material, but avoids deleterious attack of the substrate which is left after processing.

DISCLOSURE OF INVENTION

An object of the invention is to remove nickel aluminide coatings from substrate alloys such as Hastelloy-X in an economically feasible and expeditious fashion, without adversely affecting the substrate metal.

According to the invention a nickel aluminide coating is removed from a substrate of wrought non-hardenable nickel base alloy, such as Hastelloy-X, by contacting the coating with an acid solution consisting essentially by volume percent of 43–45 nitric acid, 7–12 hydrochloric acid, 0.1–1.5 sulfuric acid, balance water. Included in the solution are chloride ions and sulfate ions, such as are provided by 0.008–0.025 moles per liter of ferric chloride and at least 0.016 moles per liter of copper sulfate. The ratio between copper sulfate and iron chloride is maintained at 2:1 or greater. If the coating is of a thickness which requires more than about 20 hours removal time, the acid attack is used in combination with periodic mechanical removal of sludge, etc. such as by vapor blasting. Nickel aluminide coatings for which the invention is useful as comprised of a base of nickel with up to 10 weight percent aluminum. The non-essential quantities of other impurities. The stripping by the foregoing acid solution is conducted at a temperature of less than about 60° C., preferably less than 40° C. Most preferably, and for commercial convenience, the stripping takes place at room temperature of about 20° C. After about 72–120 hours a coating of about 6 mm thick will be entirely removed, without deleterious attack of the substrate.

BEST MODE FOR CARRYING OUT THE INVENTION

The invention is particularly useful in the removal of a nickel aluminide coating having a composition by weight of 4–5.5% Al, balance Ni, such as is obtained by plasma spraying METCO 450-NS powder (METCO Inc., Westbury, New York), from a substrate of AMS 5754 Hastelloy-X (Cabot Corp., Kokomo, Indiana) having a composition by weight percent of 22 Cr, 18.5 Fe, 1.5 Co, 9 Mo, 0.6 W, 0.1 C, balance Ni. Hastelloy-X is a wrought non-hardenable nickel base alloy. The invention herein will be useful with other like alloys which do not contain significant quantities (0.2 weight percent) of hardeners such as Ti and Al.

Our criteria for a useful method of stripping is one that may be conducted at room temperature, which involves essentially non-toxic materials, which removes the coating with minimum labor and apparatus over a total time period of less than about 7 days, and which does not remove or adversely affect the base metal. In the development of our invention, we essentially used a solution of equal parts of nitric acid and water, and included other ingredients. We ran tests until we determined the present best mode of our invention.

A Hastelloy-X turbine component having nickel aluminide coating about 6.4 mm thick is first cleaned to remove grease and dirt. It is then grit blasted in air using minus 230 U.S. mesh sieve size (0.061 mm) silicon carbide particulates for further cleaning. Next the part is immersed in an acid solution, as described below, for 20–24 hours at room temperature of about 20° C. The part is then removed from the acid solution, rinsed in water to remove sludge and the like, and cleaned by an aqueous vapor blast, using minus 200 U.S. mesh (0.074 mm) silica powder. The part is then re-immersed in the acid solution for an additional period of about 20–24 hours. The removal and wet abrasive cleaning process is repeated periodically, until about 72–120 hours have passed, whereupon it will be found that the typical coating will be removed. (Removal is easily ascertained by visual inspection.)

Through experiment we have found that the acid solution should contain the following ingredients conc. nitric acid ($HNO_3$, 40° Baume): 43–45 v/o
conc. hydrochloric acid (HCl, 22° Baume): 7–12 v/o
conc. sulfuric acid ($H_2SO_4$, 66° Baume): 0.1–1.5 v/o
copper sulfate ($CuSO_4$): $\leqq$0.016 moles/l
ferric chloride ($FeCl_3$): 0.008–0.025 moles/l
ratio between $CuSO_4$ and $FeCl_3$: $\leqq$2:1
Water ($H_2O$): balance We have found that the foregoing solution works well over the ranges indicated. However, it is preferred that the sulfuric acid content be biased toward one volume percent, since our experiments show that the sulfuric acid content is particularly critical. In its absence there is negligible rate of removal; the presence of 0.1% is dramatic. Between 0.1–1 percent, the rate of aluminide coating attack is good. It is slower at 1.5%. Solutions with 2.5, 5, and 10 v/o do not attack the coating a significant amount in 24 hr, although there may be some gas evolution, and they are thus not useful.

The inclusion of ferric chloride is important because it accelerates the rate of attack of the acid solution. However, if too much is included, intergranular attack of the Hastelloy-X substrate will result. Even within the operative range of 0.008–0.025 moles per liter, it is necessary that copper sulfate be included in the solution, to prevent intergranular attack. At least 0.016 moles per liter should be included in the solution; a ratio of copper sulfate to ferric chloride should be at least 2:1. Excess copper sulfate may be included in the solution, beyond the 2:1 ratio, as we have found it to be benign. The general effects of ferric chloride and copper sulfate in chemical milling solutions have been described in the related application Ser. No. 338,739 mentioned in the Background, the disclosure of which we hereby incorporate by reference. Of course, other compounds may be substituted for the ferric chloride and copper sulfate, as long as the chloride and sulfate ions are provided in the same approximate quantities and proportions which we indicate.

The immersion of the part to be stripped in the acid solution is preferably done at room temperature of about 20° C., since this is the lowest cost method. However, the rate of removal can be speeded up by raising the temperature of the solution, to about 40° C. But the temperature should not be increased beyond 60° C., because this will result in deleterious attack of the substrate metal. We have not found a need for agitation of the solution, but it may be optionally used to somewhat speed up processing. We have found that the typical coating is removed in about 1–5 days, without agitation or heating, and this appears to be commercially feasible.

The present invention will be suitable for removing nickel aluminide coatings applied by methods other than plasma spraying. The coatings in general will be those which are predominantly nickel and which contain 1–10 weight percent Al, plus other ingredients which do not alter the essential nature of such nickel aluminide coatings.

Although this invention has been shown and described with respect to a preferred embodiment, it will be understood by those skilled in the art that various changes in form and detail thereof may be made without departing from the spirit and scope of the claimed invention.

We claim:

1. The method of removing a nickel aluminide coating from a wrought non-hardenable nickel base alloy characterized by contacting the article with an acid solution consisting essentially by volume percent of 43–45 concentrated nitric acid, 7–12 concentrated hydrochloric acid, 0.1–1.5 concentrated sulfuric acid, balance water; the solution also containing metal chloride and metal sulfate ions.

2. The method of claim 1 characterized by a solution containing 0.008–0.025 moles per liter ferric chloride and at least 0.016 moles per liter copper sulfate, wherein the ratio between copper sulfate and ferric chloride is maintained at 2:1 or greater.

3. The method of claim 1 wherein the article is periodically removed from the acid solution and subjected to wet abrasive cleaning.

4. The method of claims 1 or 2 wherein the temperature of the acid solution is in the range 20°–60° C.

* * * * *